US005184784A

United States Patent [19]

Rose et al.

[11] Patent Number: 5,184,784

[45] Date of Patent: Feb. 9, 1993

[54] ANVIL FOR USE IN A CENTRIFUGAL IMPACT CRUSHER

[75] Inventors: Neil M. Rose, Vancouver, Wash.; Stephen B. Ackers, Portland, Oreg.; William F. Burr, Ridgefield; Brett M. Rose, Vancouver, both of Wash.

[73] Assignee: Canica Crushers, Inc., Vancouver, Wash.

[21] Appl. No.: 686,506

[22] Filed: Apr. 17, 1991

Related U.S. Application Data

[63] Continuation-in-part of Ser. No. 567,640, Aug. 15, 1990, abandoned.

[51] Int. Cl.[5] ..... B02C 19/00

[52] U.S. Cl. ..... 241/275

[58] Field of Search ..... 241/275, 299

[56] References Cited

U.S. PATENT DOCUMENTS

| | | | |
|---|---|---|---|
| 2,991,949 | 7/1961 | Sellars | 241/299 X |
| 3,168,991 | 2/1965 | Herman | 241/299 X |
| 3,540,667 | 11/1970 | Parker | 241/299 X |
| 4,090,673 | 5/1978 | Ackers | 241/275 |
| 4,659,026 | 4/1987 | Krause et al. | 241/275 |
| 4,699,326 | 10/1987 | Warren | 241/275 |
| 4,756,484 | 7/1988 | Bechler et al. | 241/275 |

*Primary Examiner*—Mark Rosenbaum
*Assistant Examiner*—Frances Chin
*Attorney, Agent, or Firm*—Chernoff, Vilhauer, et al.

[57] ABSTRACT

A plurality of generally wedge-shaped anvils, for use in a centrifugal impact rock crushing machine, line the inner wall of a containment housing. A bracket supports the anvils in the vertical direction; the inner periphery of the housing prevents the radially outward movement of the anvils and reaction forces from two adjacent anvils prevents the radially inward movement of the intervening anvil. The significant advantages of this configuration are the absence of connective means—thus eliminating a common failure mode, and the spreading of the impact forces against the anvils over a large surface area defined by the radially inward and side surfaces at the anvils.

2 Claims, 3 Drawing Sheets

ANVIL FOR USE IN A CENTRIFUGAL IMPACT CRUSHER

RELATED APPLICATIONS

This application is a continuation-in-part of application Ser. No. 07/567,640 filed Aug. 15, 1990 now abandoned.

BACKGROUND OF THE INVENTION

This invention relates to improvements to anvils used in centrifugal impact crushers.

Centrifugal impact crushing machines are used to crush rock and other materials by depositing the material on a horizontal rotating table where centrifugal force causes the material to be thrown off the table and strike stationary anvils located around the periphery of the table, thereby causing the material to fracture on impact. In order to break the material, it is hurled at the anvils at high speeds. The anvils are attached to fixtures that are mounted around the periphery of the crusher housing. Thus, the fixtures are subject to high impact loads and the fixtures and the fasteners used to join the anvils to the fixture are prone to premature failure.

An example of the prior anvil design art is shown in FIG. 2 of Ackers et al., U.S. Pat. No. 4,090,673. The anvils are retained by pins 76 mounted in the backs of the anvils that slide into slots in fixtures 78 mounted on the inside wall of the crusher housing 70. This design causes problems because the severe impact loads on the anvils can cause the pins 76 to break. When a pin breaks, the anvil falls to the bottom of the housing and, unless the machine is shut down, material will continue to strike the area of the missing anvil and cause damage to the fixture and the inner wall of the housing. This problem gave rise to the need for a method of mounting the anvils that will withstand the severe impact loads.

SUMMARY OF THE INVENTION

The present invention is directed to an improved system of mounting a series of anvils in a centrifugal impact crusher in such a way as to overcome the aforementioned problem. The design of the present invention is an improvement over the prior designs because it does away with the fixtures and structurally weak mounting pins, or other connective means that could break under the impact loads.

The subject invention accomplishes this by placing wedge-shaped anvils side by side on a shelf around the inner periphery of the crusher's cylindrical housing and relying upon the housing and the geometry of the anvils to both hold the anvils in place and to absorb the energy created by the material striking the anvils. If a first anvil is moved a small distance radially inwardly, due to its wedge shape it will press upon the side surfaces of adjacent anvils, slightly forcing those anvils apart. By forcing the adjacent anvils apart the generally circular configuration of anvils will expand slightly and the anvils will increase their pressure upon the housing's inner wall. The reaction forces of the inner wall upon the anvils is resolved within the anvil system in a direction that is perpendicular to the side surfaces of the Therefore, as the slight radially inwardly motion of the first anvil is increased the pressure upon the inner wall of the housing will be proportionally increased thereby increasing the perpendicular reaction forces between the anvils and ultimately preventing the first anvil from moving further radially inward, and the anvils are retained on the shelf.

Since the entire outside surfaces of each anvil contacts the housing wall and its entire side surface contacts an adjacent anvil, the anvil is contacted over a large surface area and impact loads on the anvils are spread out. Thus, the anvil system is not prone to breakage.

Accordingly, it is a principal object of the present invention to provide anvils for a centrifugal impact crusher in which the anvils are held in place on a shelf on the inner wall of the crusher housing by the inner wall in cooperation with the geometric shape of the anvils.

It is a further object to provide an anvil system in which impact loads on the anvils are absorbed by the housing inner wall and the sides of adjacent anvils.

It is a further object to provide anvils having an eye hook to facilitate easy removal and replacement of the individual anvils.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
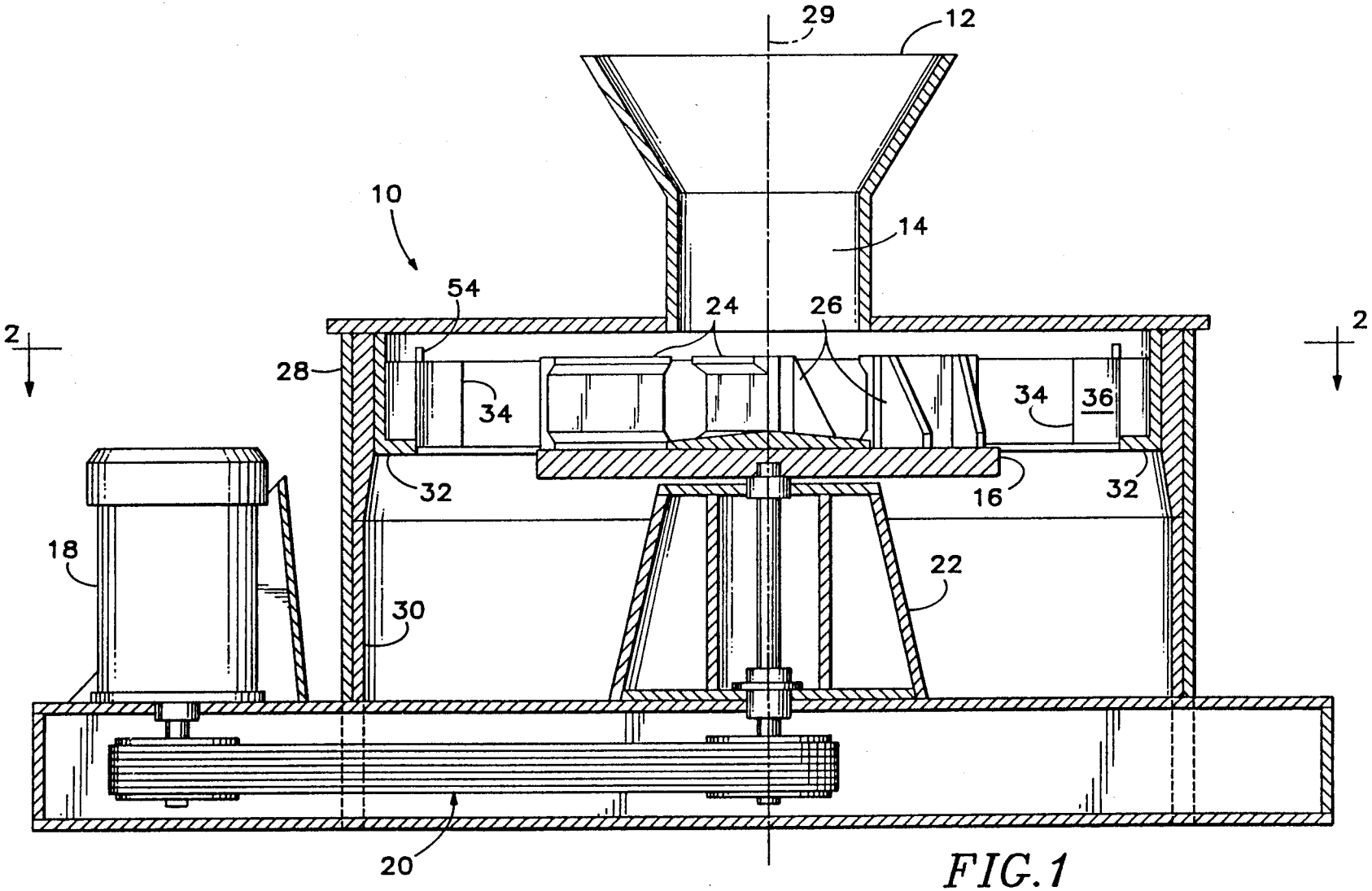
FIG. 1 is a sectional elevation view of an exemplary centrifugal impact crusher.
Figure 2:
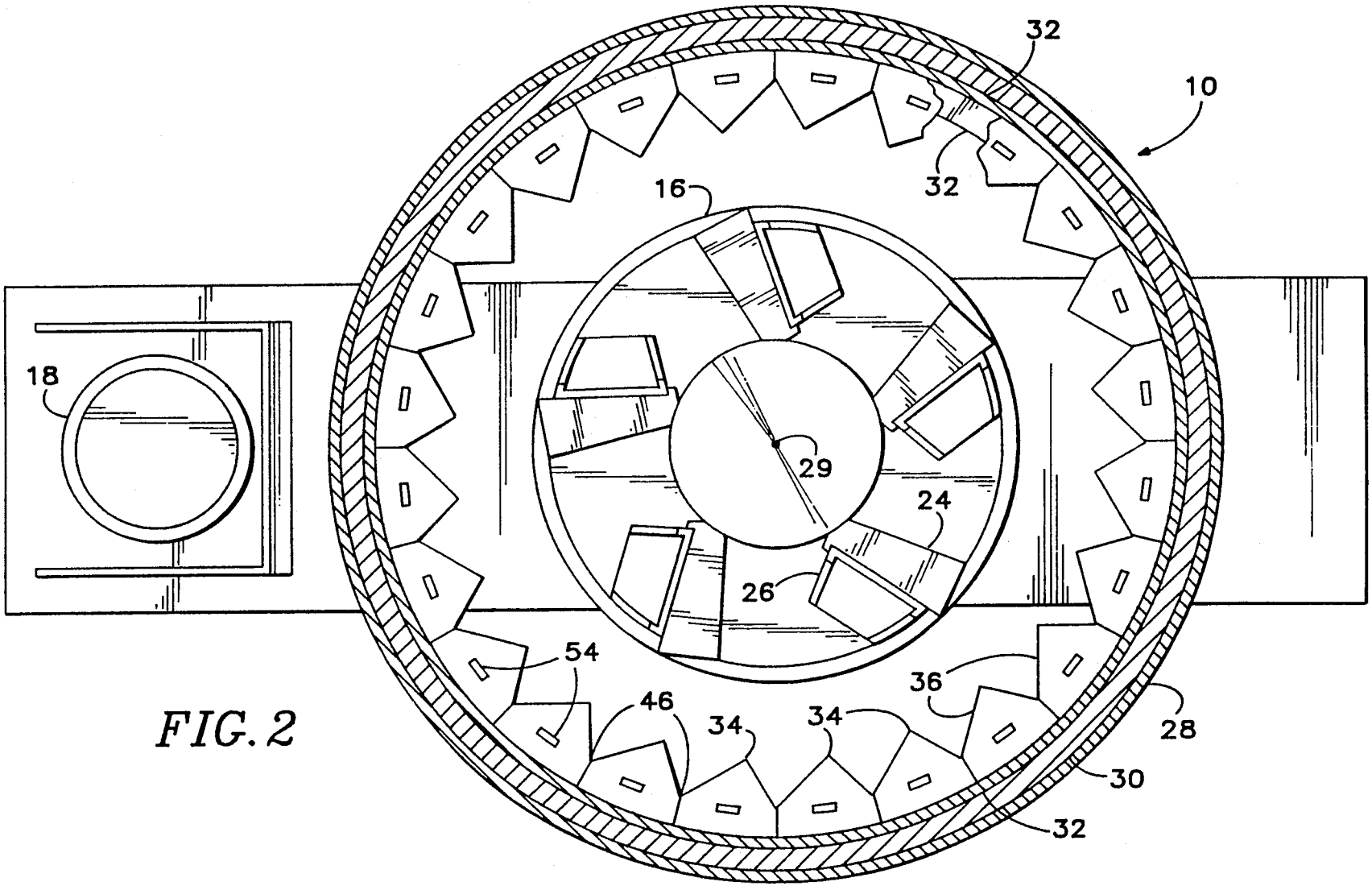
FIG. 2 is a sectional view taken along the line 2—2 in FIG. 1.

FIGS. 1 and 2 show an exemplary embodiment of a centrifugal impact crushing machine 10. The purpose of the crusher is to take in relatively large pieces of a material, such as rock, and discharge relatively smaller pieces. The crusher achieves its objective by hurling the material against immovable anvils with sufficient velocity that the material breaks upon impact.

The crusher 10 operates on a simple principle. Material is fed into the machine through the neck 14 of a feed hopper 12 and drops downward onto an impeller table 16. Meanwhile, the impeller table 16 is rotating about a vertical axis that is colinear with a central axis through the feed hopper 12. Thus, material that is gravity fed from the feed hopper onto the rotating impeller table 16 will be forced toward the outer perimeter of the table by centrifugal force. As the rock is forced outwardly it will encounter impeller blades 24 that are mounted on the table 16. As the rock moves from the central portion of the impeller table towards the outer periphery, the impeller blades prevent angular displacement of the rock relative to the impeller table so that the entire angular velocity of the impeller table imparted to the material as radial velocity. When the rock reaches the edge of the impeller table 16 it will have substantial radial velocity and will fly off the table towards a plurality of anvils 34, that extend continuously around the inner periphery of the inner wall of the housing, and break upon impact. The anvils have an impact surface 36 that faces generally radially inwardly.

The impeller table 16 is rotatably driven by an electric motor 18 via a suitable drive train, shown in FIG. 1 as a series of V-belts 20. The impeller table 16 is vertically supported by a pedestal 22 and is journaled to rotate freely. Mounted upon the impeller table are a plurality of impeller blades 24; five impeller blades are shown in the plan view of FIG. 2. The impeller blades are supported by and fixedly fastened to a gusset bracket 26 that is fixedly fastened to the impeller table 16.

The rock crushing operation is contained within an annular housing 28, that is shown in the exemplary embodiment as a right circular cylinder. The housing has an inner wall 30 and a shelf 32, which is fixedly fastened to the inner wall. In the preferred embodiment, the shelf has an L-shaped cross section and extends continuously around the entire inner periphery of the housing's inner wall in a horizontal plane that is approximately level with the top surface of the impeller table 16. The shelf 32 vertically supports the anvils 34.

Figure 3:
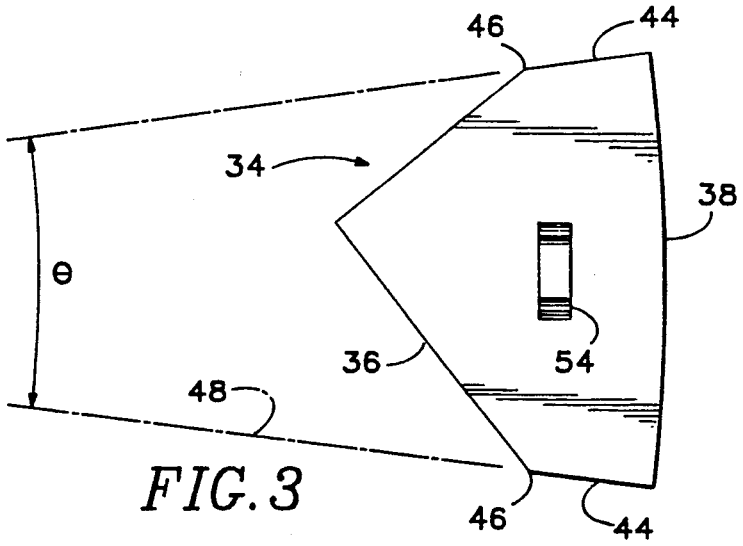
FIG. 3 is a top view of an exemplary anvil of the present invention.
Figure 4:
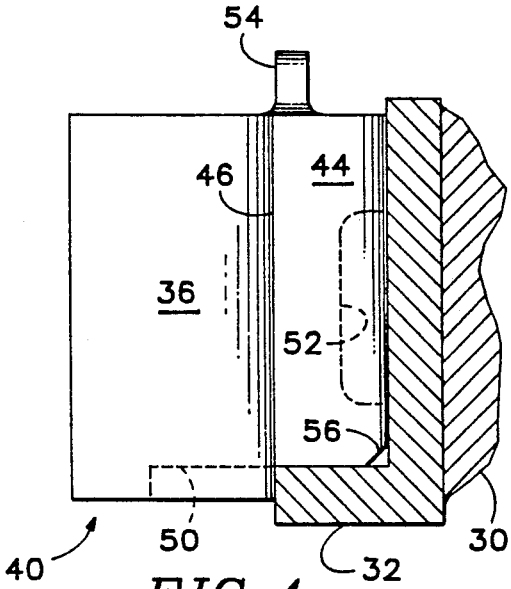
FIG. 4 is a side view of the anvil and a sectional portion of the anvil bracket and wall of the crusher housing.
Figure 5:
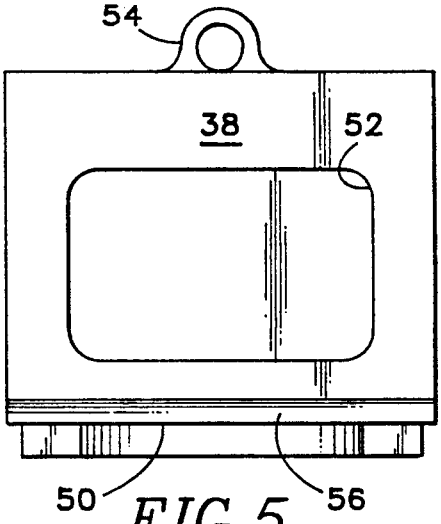
FIG. 5 is a rear view of the anvil.
Figure 6:
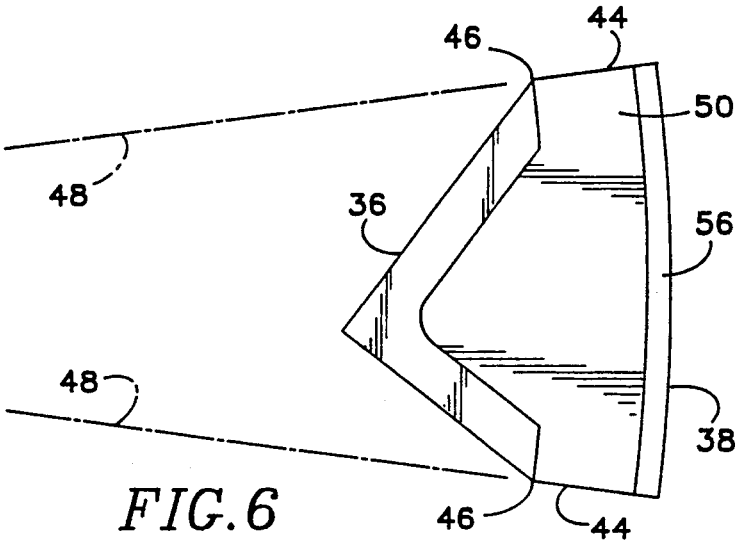
FIG. 6 is a bottom view of the anvil.

The ingenuity of the present invention is in the geometric shape of the anvils 34, which eliminates the need for mounting fixtures and fasteners and causes the anvils to be self-restraining in the radial direction. In addition, anvil loading is spread over the entire rear and side surfaces of the anvils. In its preferred embodiment, each anvil is a block of metal that is either machined or cast. Four views of the anvil are shown in FIGS. 3, 4, 5 and 6. Referring to FIG. 3, the anvil has an arcuate base surface 38, an opposed impact surface 36 and a pair of side surfaces 44 that extend between the base surface and the impact surface. The base surface and the side surfaces form the geometric properties that make the anvil self-restraining. The base surface defines an arc having a radius that is equal to the radius of a circle defined by the inner wall 30 of the housing 28. As shown in FIGS. 3 and 6, the side surfaces lie in planes that intersect and define a central angle $\Theta$. The central angle $\Theta$, in radians, is equal to the length of the base surface 38 divided by the length of the radius. A pair of shoulders 46 are formed between the side surfaces and the impact surface.

It is significant that the distance between the shoulders 46 is less than a cord joining the ends of the base surface 38. This feature, a taper of the anvil from the base surface 42 to the shoulders 46, creates the self-locking element of the present invention. The taper gives the anvil an overall wedge-shaped appearance.

Each anvil has a recessed portion 50 that is designed to cover a portion of the shelf 32. Thus, the impact surface extends down and protects the shelf from impacts from the material being crushed. There is also a dished cavity 52 open to the base surface 38 as shown in FIG. 5, and by the hidden lines in FIG. 4. The purpose of the dished cavity is to reduce the overall weight of the anvil. The preferred embodiment of the anvil also includes an eye hook 54, that serves as a convenient lifting point for its removal and replacement.

Located at the bottom of the base surface is a chamfered edge 56. The chamfered edge allows the anvil to fit matingly onto the shelf even though there may be some small amount of debris, such as rock dust, on the shelf in the corner between the horizontal surface and the vertical surfaces.

The number of anvils is determined solely by the central angle $\theta$. The number of anvils is equal to $2\pi$ divided by the central angle, in radians. In the exemplary embodiment shown there are 24 anvils, which is equal to $2\pi$ divided by the central angle of 0.2618 radians. This property is derived from the geometric properties of circle sectors.

While the planes that define the sides of the anvils in the illustrated embodiment converge at the central axis 29, this is not essential. It would be possible, for example, to have anvils with sides lying on planes that converge short of the central axis 24 and anvils having sides lying on planes that converge past the central axis. Arranging such anvils in an alternate fashion would provide the same self-locking feature as the anvils shown in the preferred embodiment.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An anvil system for a centrigual impact crusher with a housing having a circular cylindrical inner wall with a predetermined radius from a central axis, said anvil system having material impacted there against in order to shatter the material into smaller pieces, said anvil system comprising:

(a) a plurality of anvils each having a cylindrical radially outward surface that has the same radius as the inner wall of the housing, a radially inward surface defining an impact element, and opposed planar side surfaces, aligned generally radially, and defining a pair of vertical planes that pass through the housing central axis when said outward surface is in contact with the housing inner wall;

(b) a shelf that extends radially inward from the housing inner wall and supports said anvils against vertical displacement with the outward surface of said anvils being in direct contact with the housing inner wall, and the side surfaces of each anvil being in direct contact with the side surface of an anvil on each side thereof; and said shelf, the side walls of the anvils being in contact with one another and the inner wall of the housing in combination being the sole means for preventing displacement of said anvils from said shelf.

2. The anvil system of claim 1 wherein each of said anvils has a lower surface having a recessed portion adjacent to said outward surface, said recess portion overlying said shelf when said outward surface is contact with the housing inner wall.

* * * * *

UNITED STATES PATENT AND TRADEMARK OFFICE

CERTIFICATE OF CORRECTION

PATENT NO. : 5,184,784

DATED : February 9, 1993

INVENTOR(S) : Neil M. Rose, et al.

It is certified that error appears in the above-identified patent and that said Letters Patent is hereby corrected as shown below:

Column 1 Line 63: after "of the" insert --anvils.--

Column 4 Line 52: after "side thereof; and" insert --(c)--

Column 4 Line 60: after "surface is" insert --in--

Signed and Sealed this

Thirtieth Day of November, 1993

Bruce Lehman

*Attest:*

BRUCE LEHMAN

*Attesting Officer*

*Commissioner of Patents and Trademarks*